US008082722B2

(12) United States Patent
Gustafsson

(10) Patent No.: US 8,082,722 B2
(45) Date of Patent: Dec. 27, 2011

(54) DEVICE FOR PLACING CONTAINERS OF COLLAPSIBLE TYPE IN A DISTRIBUTION UNIT

(75) Inventor: Per Gustafsson, Bjarred (SE)

(73) Assignee: Ecolean Research & Development A/S, Copenhagen (DK)

( * ) Notice: Subject to any disclaimer, the term of this patent is extended or adjusted under 35 U.S.C. 154(b) by 70 days.

(21) Appl. No.: 12/513,756

(22) PCT Filed: Nov. 7, 2007

(86) PCT No.: PCT/SE2007/000983

§ 371 (c)(1), (2), (4) Date: May 6, 2009

(87) PCT Pub. No.: WO2008/057021

PCT Pub. Date: May 15, 2008

(65) Prior Publication Data

US 2009/0301040 A1 Dec. 10, 2009

(30) Foreign Application Priority Data

Nov. 8, 2006 (SE) ..... 0602362

(51) Int. Cl.

| | |
|---|---|
| ***B65B 5/06*** | (2006.01) |
| ***B65B 5/08*** | (2006.01) |
| ***B65B 5/10*** | (2006.01) |
| ***B65B 35/16*** | (2006.01) |
| ***B65B 35/36*** | (2006.01) |
| ***B65B 35/56*** | (2006.01) |

(52) U.S. Cl. ..... 53/537; 53/544; 53/244; 53/251; 198/377.03; 198/377.07

(58) Field of Classification Search ..... 53/531, 53/537, 544, 235, 244, 247, 251; 198/406, 198/409, 375, 377.03, 377.06, 377.07; *B65B 5/06, B65B 5/08, 5/10, 35/16, 35/36, 35/56*

See application file for complete search history.

(56) References Cited

U.S. PATENT DOCUMENTS

| | | | | |
|---|---|---|---|---|
| 3,456,423 | A * | 7/1969 | Helms | 53/544 |
| 3,766,706 | A | 10/1973 | Graham | |
| 3,951,274 | A * | 4/1976 | Yamamoto | 53/544 |
| 4,051,652 | A * | 10/1977 | Hirano et al. | 53/544 |
| 4,648,233 | A * | 3/1987 | Holland | 53/251 |
| 4,776,148 | A | 10/1988 | Mingozzi | |
| 5,239,807 | A | 8/1993 | Soleri | |
| 5,257,493 | A * | 11/1993 | Cocchi et al. | 53/544 |
| 5,271,208 | A | 12/1993 | Christine et al. | |
| 5,967,291 | A * | 10/1999 | Hansen | 198/409 |
| 7,744,139 | B1 * | 6/2010 | Kalisch et al. | 294/87.1 |
| 2002/0148203 | A1 | 10/2002 | Waddell, II et al. | |

(Continued)

FOREIGN PATENT DOCUMENTS

| | | | |
|---|---|---|---|
| CA | 2367098 | A | 11/2000 |

(Continued)

*Primary Examiner* — Stephen F Gerrity

(74) *Attorney, Agent, or Firm* — Volpe and Koenig, P.C.

(57) ABSTRACT

The device places filled and sealed collapsible containers. The device has a gripping unit with a number of finger pairs that correspond to the number of containers in a packing state. The gripping unit has a gripping state in which each finger is arranged to make a squeezing motion such that the contents of the container forms an inner counter-pressure structure to provide a well-defined grip.

15 Claims, 9 Drawing Sheets

U.S. PATENT DOCUMENTS

| | | | |
|---|---|---|---|
| 2004/0187445 | A1 | 9/2004 | Hilderbrand, Jr. |

FOREIGN PATENT DOCUMENTS

| | | | | |
|---|---|---|---|---|
| DE | 2240541 | A | | 5/1973 |
| EP | 1647485 | A | | 4/2006 |
| JP | 11059623 | A | * | 3/1999 |
| JP | 11208606 | A | * | 8/1999 |
| WO | 2005100156 | A | | 10/2005 |

* cited by examiner

DEVICE FOR PLACING CONTAINERS OF COLLAPSIBLE TYPE IN A DISTRIBUTION UNIT

FIELD OF THE INVENTION

The present invention relates to a device and a method for placing advanced, filled and sealed containers in a distribution unit, and more specifically a device and a method arranged for handling of containers which are of a collapsible type and which are suspended and arranged one after the other along a longitudinal axis.

BACKGROUND ART

In the food industry, containers that have been filled and sealed in a filling machine are usually supplied to a conveyor belt for further transport to a device for packeting the containers.

Packeting may comprise, for instance, placing the containers in a distribution unit, such as a box.

If the containers are made of a rigid packaging material, such as cardboard, positioning of the containers can be performed by braking a front container, after which subsequent containers are lined up after the braked container while being simultaneously aligned. The rigidity of the container type in combination with its shape promotes said alignment. Subsequently, the aligned group of containers can be placed in the distribution unit by an automated process.

However, a more and more frequently used container is of a collapsible type. Such containers are made of a flexible packaging material and thus do not have the same rigid structure as the above described container type and therefore cannot be aligned and positioned in the way as described above.

To place containers of a collapsible type in a box, manual work or use of a robotised packeting device therefore is required.

These two methods of packeting filled and sealed containers of a collapsible type result in relatively high costs.

SUMMARY OF THE INVENTION

In view of that stated above, an object of the present invention is to provide a device for placing containers of a collapsible type in a distribution unit, which device is comparatively simple and, thus, inexpensive.

It is also an object of the present invention to provide a method which in a simple and rational manner allows placing of containers of a collapsible type which are suspended and arranged one after the other in a distribution unit.

More specifically, according to the present invention a device is provided for placing filled and sealed containers of a collapsible type in a distribution unit, said containers being moved to a packing position, in which the containers are suspended and arranged along a longitudinal axis, comprising a gripping unit with a number of finger pairs corresponding to the number of containers in the packing position, each finger pair, in a non-gripping state of the gripping unit, having a finger gap which allows a container to pass. The gripping unit is operable to a gripping state, in which each finger pair is arranged to make a squeezing motion to grip a container.

As a result, a simple and inexpensive device is provided for placing suspended containers of a collapsible type in a distribution unit. By the device being capable of handling containers which are suspended and lined up along a longitudinal axis, the exact positioning of the containers which is achieved in a filling machine can be utilised. This exact positioning is used, more specifically, by a gripping unit which is of a relatively simple construction. The gripping unit comprises finger pairs which in a gripping state are arranged to make a squeezing motion to grip one container each. By the container being of a collapsible type, each container will yield in the gripped portion. This makes it possible to grip the container with such a squeezing force that the contents of the container form an inner counter-pressure structure to provide a well-defined grip.

The gripping unit of the inventive device can be movable between a gripping position and a placing position, in which gripping position the gripping unit is arranged to grip the containers in the packing position by operating the gripping unit to its gripping state, and in which placing position the gripping unit is arranged to place the gripped containers in the distribution unit.

The gripping unit of the device can be movable along a movement axis, which is perpendicular to said longitudinal axis, the gripping unit being movable between the gripping position and the placing position by moving along said movement axis.

The gripping unit of the device can also be pivotable about a pivot axis, which is parallel to said longitudinal axis. The gripping unit can be movable along a movement axis, which is perpendicular to said pivot axis and which coincides with a plane defined by said longitudinal axis and said pivot axis, the gripping unit being movable between the gripping position and the placing position by pivoting about the pivot axis and moving along the movement axis.

The device can thus be pivotable about a pivot axis and movable along a movement axis which may extend perpendicular to said pivot axis. These degrees of freedom make it possible to grip the suspended containers and place the containers in a lying state in the distribution unit.

In one embodiment of the present invention, the gripping unit is in its gripping position arranged to grip containers in the packing position merely from one container side. The gripping unit can, in order to move from the gripping position to the placing position, be arranged to pivot about the pivot axis in a first pivot direction and move along the movement axis in a first movement direction. To move from the placing position to the gripping position, the gripping unit can be arranged to pivot about the pivot axis in a second pivot direction opposite to the first pivot direction, and move along the movement axis in a second movement direction opposite to the first movement direction. This makes it possible to ensure that the containers placed in the distribution unit obtain the same orientation. This can be advantageous if the distribution unit is also adapted to serve as an exposure unit for the containers in a food shop for instance. By raising the distribution unit, the containers can be oriented in an upright position and by removing a wall portion of the distribution unit, easy access to the upright containers is allowed.

Alternatively, the device may comprise a handling element which is arranged to turn the distribution unit (box) through 180° each time the gripping unit has placed containers in said distribution unit. Although the gripping unit grips the containers in the packing position from the same container side, the containers placed in the distribution unit will be given an alternating orientation. As a result, efficient use of the volume of the distribution unit is allowed.

In another embodiment of the inventive device, the gripping unit is in its gripping position arranged to grip containers in the packing position alternately from a first container side and a second container side. To move from the gripping position to grip containers from the first container side to the placing position, the gripping unit can be arranged to pivot about the pivot axis in a first pivot direction and move along the movement axis in a first movement direction. To move from the placing position to the gripping position to grip containers from the second container side, the gripping unit can be arranged to pivot about the pivot axis in the first pivot direction and move along the movement axis in a second movement direction opposite to the first movement direction. To move from the gripping position to grip containers from the second container side to the placing position, the gripping unit can be arranged to pivot about the pivot axis in a second pivot direction opposite to the first pivot direction, and move along the movement axis in the first movement direction. To move from the placing position to the gripping position to grip containers from the first container side, the gripping unit can be arranged to pivot about the pivot axis in the second pivot direction and move along the movement axis in the second movement direction.

This means that the containers will be placed in the distribution unit with alternately opposite orientation, which helps to improve the use of the volume of the distribution unit.

The gripping unit of the device can be arranged to grip containers in groups of at least two containers. Preferably, a group of containers fills an entire level in the distribution unit.

In another embodiment, the gripping unit may comprise a back piece to support all finger pairs. The back piece may support at least two finger pairs, the finger pairs being movable between a pushed-together state and a separated state. It will thus be possible to grip the suspended containers arranged at a first distance to each other, and place them in the box at a second distance to each other. The second distance can be smaller than the first distance, which allows additionally improved use of the volume of the distribution unit.

The gripping unit of the device may be pivotable about a pivot axis which is parallel to said longitudinal axis and may be movable along a movement axis, which is perpendicular to said pivot axis and which coincides with a plane defined by said longitudinal axis and said pivot axis, the device further comprising a pivoting motor which is movable parallel to said movement axis, the gripping unit being pivotally supported by said pivoting motor for pivoting about said pivot axis. As a result, the movability of the gripping unit is easily achieved. The gripping unit can be supported by the pivoting motor by means of an arm which is extended perpendicular to the pivot axis and which at a first end is connected to the pivoting motor and which at a second end is connected to the back piece.

The back piece may be pivotally connected to the second end of said arm. This makes it possible to adjust an angle between the finger pairs and said arm. More specifically, it will be possible to adjust the gripping unit to grip the containers at a point above or below the pivot axis, which, in connection with the placing of the containers in the distribution unit, makes it possible to laterally displace the container. The direction of said lateral displacement is dependent on from which container side the container was gripped by the gripping unit, which makes it possible to further improve the use of the volume of the distribution unit.

The device may further comprise a handling element which is arranged to alternately laterally displace the distribution unit in mutually opposite directions before each placing of containers in the distribution unit. This results in an alternative way to provide said lateral displacement of the containers.

In another embodiment of the present invention, the device forms a module which is connectable to a filling machine for filling containers of a collapsible type. Alternatively, the device may be an integral part of a filling machine for filling containers of a collapsible type.

Moreover, according to the present invention a method is provided for placing filled and sealed containers of a collapsible type in a distribution unit, which containers are moved to a packing position suspended and arranged along a longitudinal axis. The method comprises gripping by a squeezing movement, from one of a first and a second container side, the containers in the packing position individually, each container being gripped with such a squeezing force that the contents of the container form an inner counter-pressure structure to provide a well-defined grip.

This results in a method, which allows utilisation of the exact positioning of containers which can be provided in a filling machine. By the method comprising gripping each container separately in the packing position by making a squeezing movement, the gripped containers—which are of a collapsible type—will yield in the gripped portion until the contents of the containers form an abutment, or a counter-pressure structure, which provides a well-defined grip. This ensures that the gripped container does not slide or is not displaced in any other manner, whereby it will be possible to keep the position of the container under perfect control.

The method may further comprise pivoting the gripped containers about a pivot axis so that the other of the first and the second container side is oriented downwards, said pivot axis being parallel to said longitudinal axis and located in a vertical plane comprising said longitudinal axis, moving the gripped containers in a vertical downward direction and placing the gripped container in the distribution unit by letting go of them, and subsequently repeating the process until the distribution unit is filled with containers. This allows placing of the containers in the distribution unit with efficient use of its volume.

In one embodiment of the method, the containers in the packing position are gripped merely from the first container side. This embodiment of the method may also comprise turning the distribution unit (box) through 180° prior to the step of placing the gripped containers in the distribution unit.

In a further embodiment of the method, the containers in the packing position are alternately gripped from the first container side and the second container side. The step of placing the gripped containers in the distribution unit can be preceded by the step of laterally displacing the gripped containers relative to the distribution unit.

BRIEF DESCRIPTION OF THE DRAWINGS

Embodiments of the present invention will in the following be described by way of example and with reference to the accompanying drawings.

DESCRIPTION OF EMBODIMENTS

Figure 1:
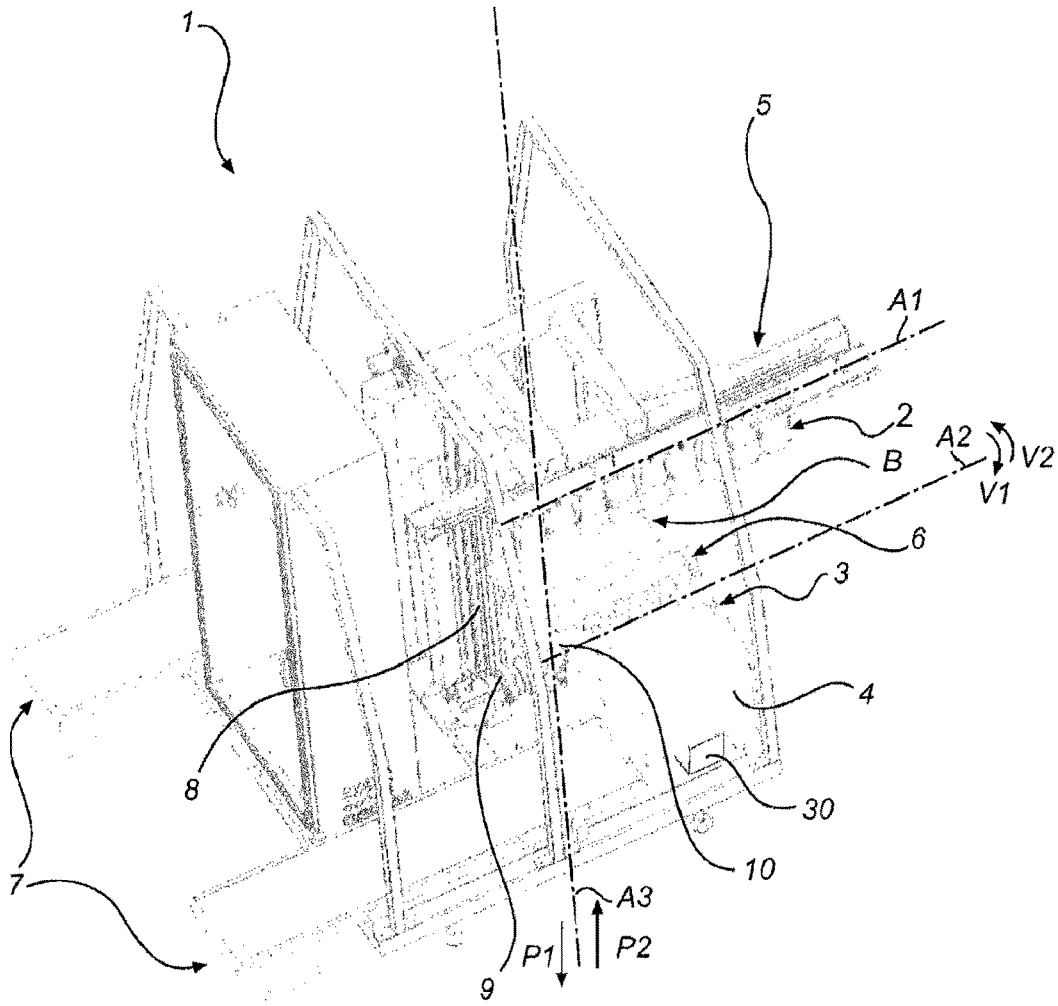
FIG. 1 is a perspective view of an inventive device for handling filled and sealed containers of a collapsible type.

The invention concerns a device 1 shown in FIG. 1 for placing filled and sealed containers 2 of a collapsible type in distribution units 3, for instance in the form of boxes 4.

By containers 2 of a collapsible type are meant containers which have a compartment which is defined by flexible walls, which walls are interconnected along a connecting portion. The walls usually comprise two opposite side walls and a bottom wall. The walls can be made in one piece of a laminated packaging material which may comprise a core layer of a polyolefin material filled with mineral.

The containers 2 placed in the boxes 4 can then be further distributed.

The inventive device 1 may, as shown in the figure, constitute a module which is connectable to a filling machine (not shown). Alternatively, the device 1 may constitute an integral part of the filling machine.

The device 1 comprises an arrangement 5 for receiving the containers 2 which have been filled and sealed in the filling machine. The containers 2 are moved to a packing position B in which they are suspended and arranged one after the other along a longitudinal axis A1 in a well-defined spaced-apart relationship.

If the device 1 is an integral part of a filling machine, the device 1 can be arranged for handling the containers 2 when, after filling and sealing, they have been moved to a packing position, in which they are suspended in the filling machine, one after the other along a longitudinal axis.

The device 1 further comprises a gripping unit 6 which is movable between a gripping position and a placing position. In the gripping position the gripping unit 6 is arranged to grip the suspended containers 2 in the packing position B from one container side. In the placing position the gripping unit is arranged to place the gripped containers 2 in the boxes 4. The device 1 comprises an arrangement 7 for supplying empty boxes 4 and for discharging the boxes 4 when filled with containers 2.

The gripping unit 6 is arranged to grip the containers 2 which are suspended in the packing position B and, thus, vertically oriented and to move them, while pivoting, to place them horizontally oriented in a box 4.

The gripping unit 6 can be arranged to grip one container 2 or to grip containers 2 in groups of at least two containers, and in the shown embodiment the gripping unit 6 is arranged to grip containers 2 in groups of four containers.

By the containers 2 being of a collapsible type, each container will yield in the gripped portion until the contents of the container form a counter-pressure structure or an abutment, thereby obtaining a well-defined grip.

When the gripping unit 6 has placed the gripped group of containers 2 (or the individual container) in a box 4, the gripping unit 6 is returned to its gripping position to grip a new group of containers 2 which has been moved to the packing position B. The gripping unit 6 may be arranged to place the new group of containers 2 on the containers 2 already placed in the box 4, and then repeat the process of gripping and placing containers 2 until the box 4 is filled with containers 2.

As mentioned above, the gripping unit 6 is movable from its gripping position to its placing position by moving while being pivoted. More specifically, the gripping unit 6 is pivotable about a pivot axis A2 which is parallel to the longitudinal axis A1 and movable along a movement axis A3 which is perpendicular to the pivot axis A2 and located in a plane defined by the pivot axis A2 and the longitudinal axis A1.

The device 1 has a pillar stand 8, on which a pivoting motor 9 is movably arranged to move parallel to said movement axis A3 in a first movement direction P1 and in a second movement direction P2 which is opposite to said first movement direction P1.

The pivoting motor 9 has an output shaft journal (not shown), which by driving of the pivoting motor 9 is pivotable about the pivot axis A2 in a first pivot direction V1 and in a pivot direction V2 which is opposite to the first pivot direction V1.

Figure 2:
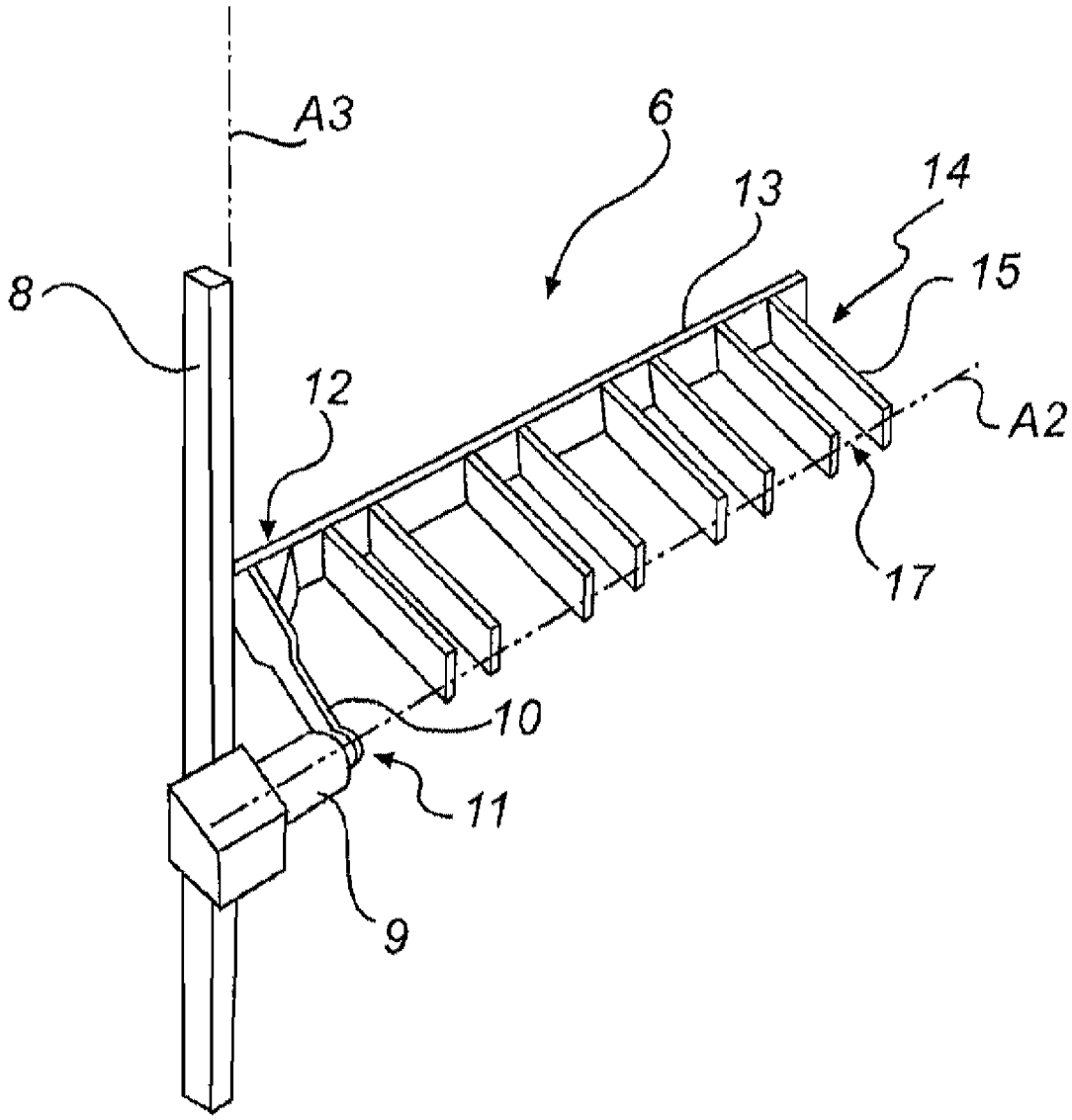
FIG. 2 is a perspective view of a gripping unit for the device illustrated in FIG. 1.

As schematically shown in FIG. 2, to which reference is now also made, the gripping unit 6 is supported by the pivoting motor 9 by means of an arm 10 which extends perpendicular to the pivot axis A2 and which at a first end 11 is connected to the shaft journal and which at a second end 12 is connected to a back piece 13 of the gripping unit 6.

This means that the gripping unit 6 is movable along said movement axis A3 by moving of the pivoting motor 9 along said pillar stand 8 and pivotable about said pivot axis A2 by actuation of said pivoting motor 9.

The back piece 13 of the gripping unit 6 supports a plurality of finger pairs 14. The number of finger pairs 14 corresponds to the number of containers 2 that are included in the group of containers 2 which is adapted to be handled by the gripping unit 6. In the embodiment shown in FIG. 1, the gripping unit 6 is adapted to handle containers 2 in groups of four containers 2 and, consequently, the back piece 13 supports four finger pairs 14. Each finger pair 14 is adapted to handle one container 2.

The gripping unit 6 is operable between a gripping state and a non-gripping state.

It is evident from FIG. 2 how the fingers 15 included in the finger pairs 14 define between them a gap 17, which in the non-gripping state of the gripping unit 6 allows a container 2 to pass.

In the gripping state of the gripping unit 6 each finger pair 14 acts to hold a container 2 positioned between the fingers 15 of the finger pair 14 in question.

The gripping unit 6 can be arranged to grip, in its gripping position, groups of containers 2 merely from one container side. Alternatively, the gripping unit 6 can be arranged to grip, in its gripping position, groups of containers 2 alternately from a first and a second container side.

If the containers 2 or the groups of containers are gripped merely from one container side, the containers 2 can be placed one upon the other in the distribution unit 3 with the same orientation.

If the containers 2 or the groups of containers are alternately gripped from a first and a second container side, the subsequent containers 2 will, with the gripping unit 6 in its placing position, have an orientation in the horizontal plane which is opposite to that of the preceding containers 2. It is evident from FIG. 3, to which reference is now made, how a first preceding group G1 of containers 2 has been placed in a distribution unit 3 in the form of a box 4 with a first orientation in the horizontal plane, and how a second subsequent group G2 of containers 2 has been placed in the box 4, on the first group G1 of containers 2 but with an opposite orientation in the horizontal plane. The pattern of placing is repeated until the box 4 is filled.

The same pattern of placing can be provided even if the gripping unit 6 in its gripping position is arranged to grip containers 2 merely from one container side. More specifically, this can be achieved by the inventive device comprising a handling element (30) which is adapted to turn the distribution unit (box) through 180° each time the gripping unit has placed a group of containers in the box.

FIGS. 4*a*-4*g*, to which reference is now made, illustrate schematically the pattern of movement of the gripping unit 6 of an inventive device 1 according to a first embodiment. In this embodiment, the gripping unit 6 is arranged to grip, in its gripping position, containers 2 from a first container side 18.

The gripping unit 6 is arranged to handle containers 2 which are moved to a packing position B, in which they are suspended, one after the other along a longitudinal axis A1 which in the shown example is extended in the horizontal plane.

In the figures, the gripping unit 6 acts to grip one container 2 at a time and therefore comprises only one finger pair 14, but it will be appreciated that, as discussed above, the gripping unit 6 can be arranged to grip containers 2 in groups of several containers 2.

The finger pair 14 of the gripping unit 6 extends parallel to the arm 10 and is thus perpendicular to the pivot axis A2, about which the gripping unit 6 is pivotable.

Figure 4D:
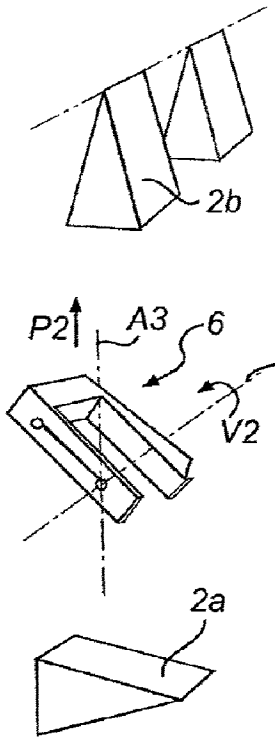
FIGS. 4*a*-4*g* illustrate schematically the method of placing in a distribution unit suspended containers by means of a gripping unit of an inventive device according to a first embodiment.
Figure 4C:
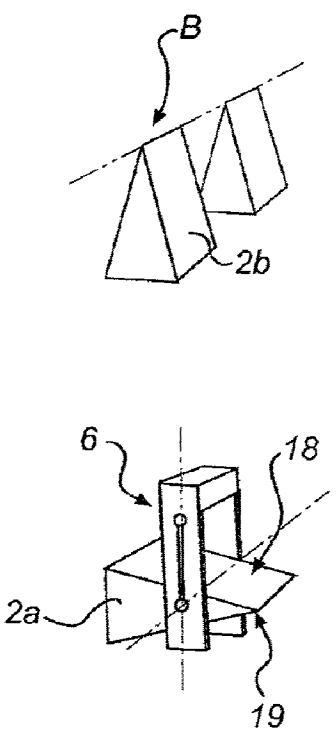
Figure 4B:
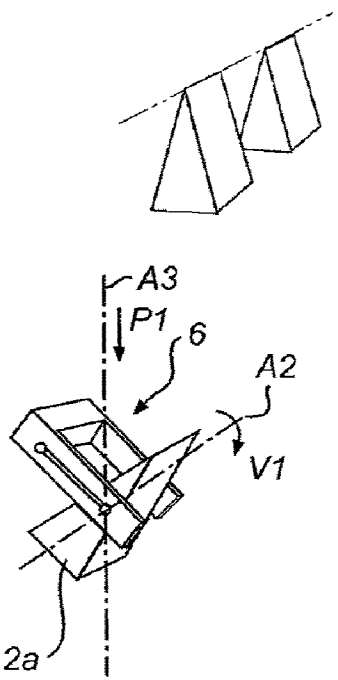
Figure 4A:
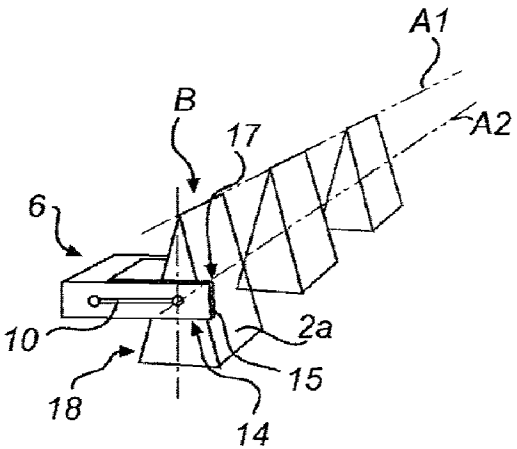

In FIG. 4*a*, the gripping unit 6 is arranged in its gripping position and has taken a position for gripping a first container 2*a* from a first container side 18.

When the gripping unit 6 is arranged in its gripping position, its finger pair 14 has an extent that intersects the plane defined by the longitudinal axis A1 and the pivot axis A2.

By the fingers 15 of the finger pair 14 of the gripping unit 6, in the non-gripping state of the gripping unit, defining between them a gap 17 which allows a container 2*a* to pass, the gripping unit 6 can easily take said gripping position.

Once the gripping unit 6 has taken the gripping position, it is operated to its gripping state, in which the fingers 15 of the finger pair 14 make a squeezing motion to grip the first container 2*a*. Since the container 2*a* is of a collapsible type, the container 2*a* will yield in the squeezed portion and the contents of the container form a counter-pressure structure. This results in a well-defined grip of the container 2*a*.

FIG. 4*b* illustrates the gripping unit 6 while moving from the gripping position to the placing position. The gripping unit 6 remains in its gripping state and will thus bring along the first container 2*a* to the placing position.

During this movement, the gripping unit 6 is moved along the movement axis A3 in the first movement direction P1 and pivoted about the pivot axis A2 in the first pivot direction V1.

FIG. 4*c* shows the gripping unit 6 in the placing position, in which the gripping unit 6 is arranged to place the gripped containers 2 in the box (not shown). More specifically, the first container 2*a* has been pivoted so that a second container side 19 opposite to the first container side 18 is oriented downwards. The first container 2*a* can now be placed in the box (not shown) by operating the gripping unit 6 to its non-gripping state.

FIG. 4*c* also shows how a second container 2*b* has been advanced to the packing position B and, thus, taken the position of the first container 2*a* before it was collected by the gripping unit 6.

FIG. 4*d* illustrates the gripping unit 6 while moving from the placing position back to the gripping position to grip a container 2 from the first container side 18. The gripping unit 6 leaves the first container 2*a* in the box and is moved to the gripping position without a container.

During this movement, the gripping unit 6 is moved along said movement axis A3 in the second movement direction P2 which is opposite to the first movement direction P1 and pivoted about the pivot axis A2 in the second pivot direction V2 which is opposite to the first pivot direction V1.

Figure 4G:
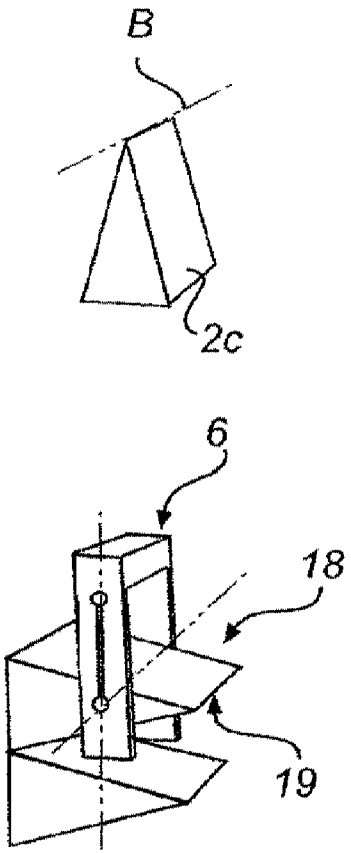
Figure 4F:
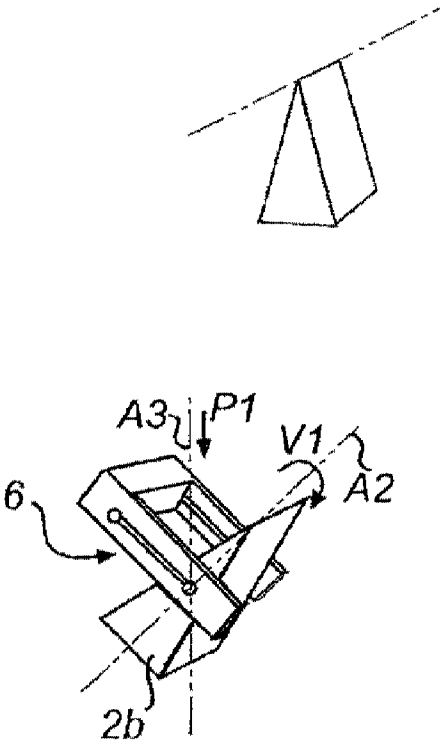
Figure 4E:
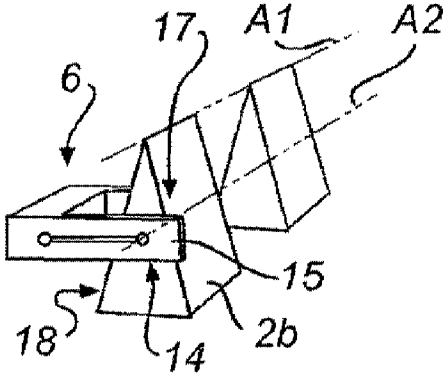

In FIG. 4*e*, the gripping unit 6 has taken the gripping position to grip the second container 2*b* from the first container side 18.

In said gripping position, the finger pair 14 of the gripping unit 8 has, like before, an extent that intersects the plane defined by the longitudinal axis A1 and the pivot axis A2.

Since the fingers 15 of the finger pair 14 of the gripping unit 6 in the non-gripping state of the gripping unit 6 define between them a gap 17 which allows a container 2*b* to pass, the gripping unit 6 can easily take the gripping position.

Once the gripping unit 6 has taken the gripping position, it is operated to its gripping state, in which the fingers 15 of the finger pair 14 make a squeezing motion to grip the second container 2*b*.

FIG. 4*f* illustrates the gripping unit 6 while moving from the gripping position to the placing position. The gripping unit 6 remains in its gripping state and will thus bring along the second container 2*b* to the placing position.

During this movement, the gripping unit 6 is moved along said movement axis A3 in the first movement direction P1 and pivoted about the pivot axis A2 in the first pivot direction V1.

FIG. 4*g* shows the gripping unit 6 in the placing position, in which the second container 2*b* has been pivoted so that the second container side 19 which is opposite to the first container side 18 is oriented downwards. The second container 2*b* can now be placed in the box (not shown), on the first container 2*a* and with the same orientation in the horizontal plane, by operating the gripping unit 6 to its non-gripping state.

Figure 3:
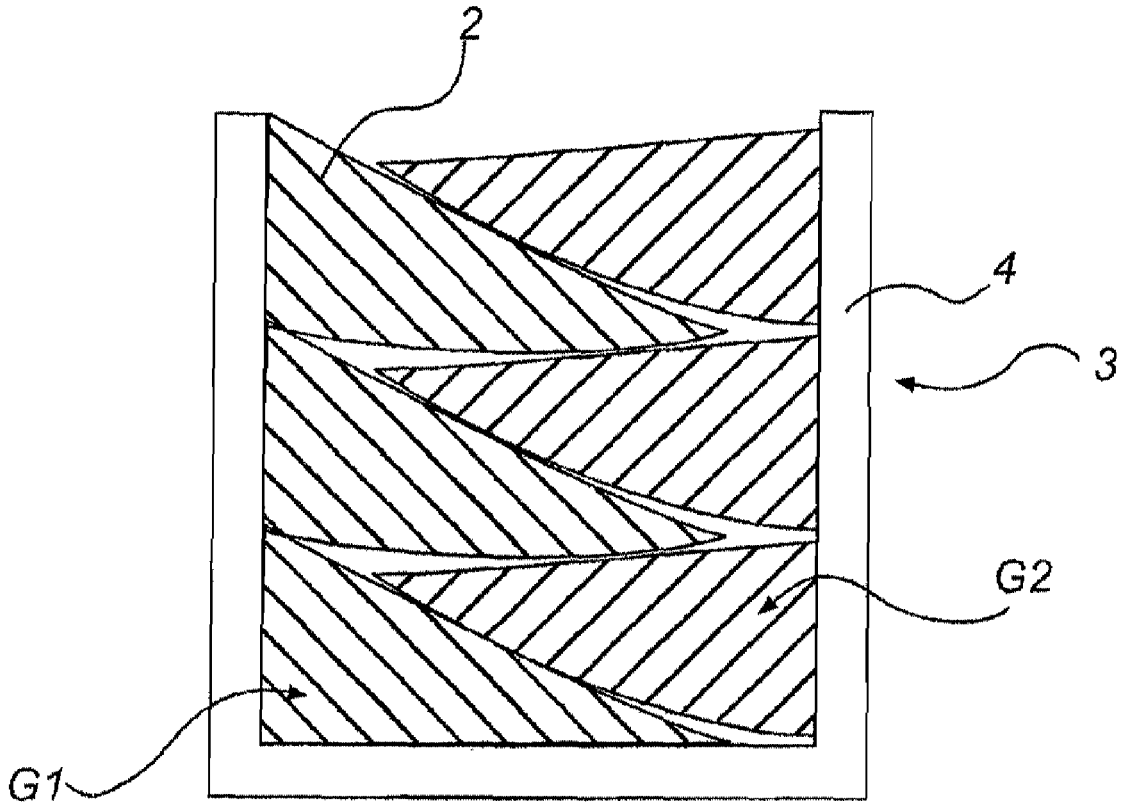
FIG. 3 is a schematic cross-sectional view of a distribution unit, in which an inventive device has placed filled and sealed containers of a collapsible type.

As mentioned above, the inventive device may comprise a handling element (not shown) which is adapted to turn the distribution unit (box) each time a container has been placed in the same to provide the pattern of placing illustrated in FIG. 3.

FIG. 4*g* also shows how a third container 2*c* has been advanced to the packing position B and taken the position that was previously taken by the first container 2*a* and then by the second container 2*b*.

Subsequently the gripping unit 6 (not shown) is again moved to the gripping position to repeat the above described process until the box (not shown) is filled with containers 2.

FIGS. 5*a*-5*g*, to which reference is now made, illustrate schematically the pattern of movement of the gripping unit 6 of an inventive device 1 according to a second embodiment. In this embodiment, the gripping unit 6 is arranged to grip in its gripping position containers 2 alternately from a first 18 and a second 19 container side.

Figure 5C:
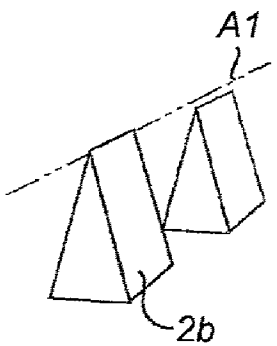
FIGS. 5*a*-5*g* illustrate schematically the method of placing in a distribution unit suspended containers by means of a gripping unit of an inventive device according to a second embodiment.
Figure 5C:
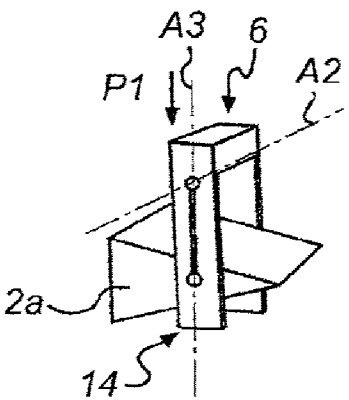
Figure 5B:
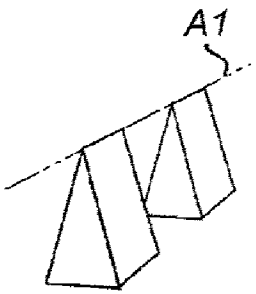
Figure 5B:
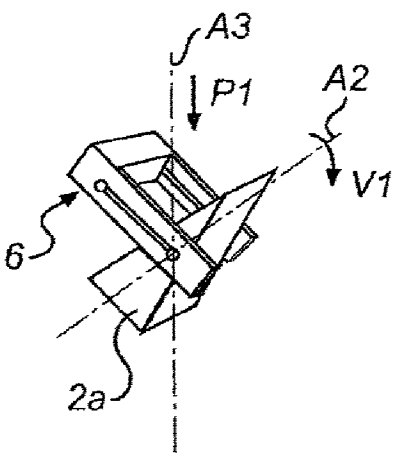
Figure 5A:
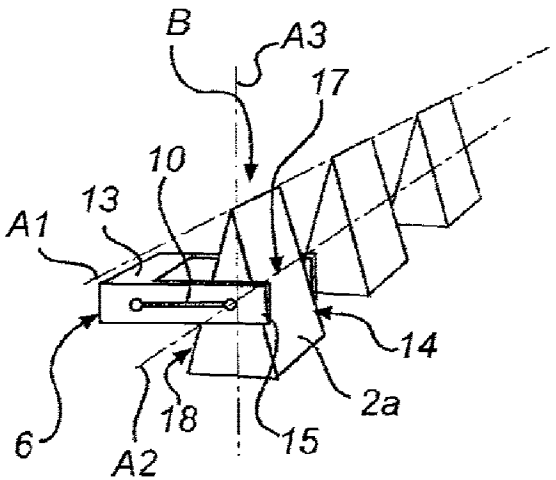
Figure 5D:
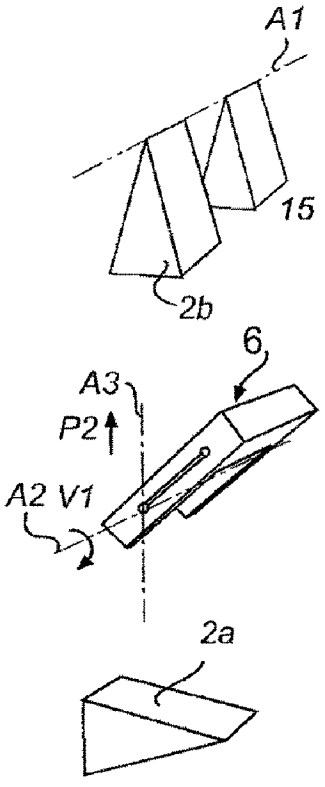
Figure 5E:
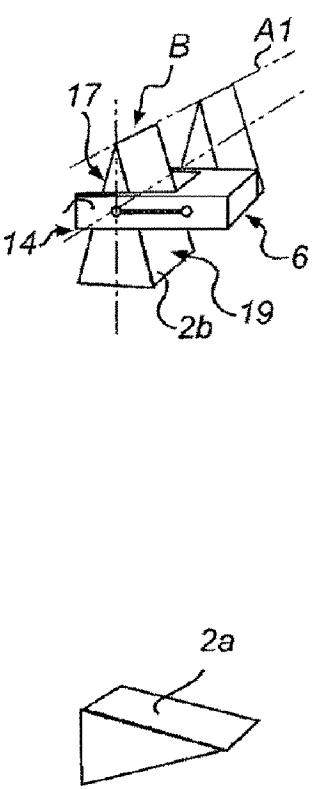

What differs this second embodiment from the first embodiment which has been described with reference to FIG. 4*a*-4*g* is that the gripping unit 6 in the second embodiment, after placing the first container 2*a* in the box (not shown), is moved from the placing position to a gripping position to grip the second container 2*b* from the second container side 19, which is shown in FIGS. 5*d*-5*e*.

During this movement, which is particularly evident from FIG. 5*d*, the gripping unit 6 is thus moved along said movement axis A3 in the second movement direction P2 which is opposite to the first movement direction P1 and continues to be pivoted about the pivot axis A2 in the first pivot direction V1.

In FIG. 5*e*, the gripping unit 6 has taken the gripping position to grip the second container 2*b* from the second container side 19 which is opposite to the first container side 18.

Figure 5F:
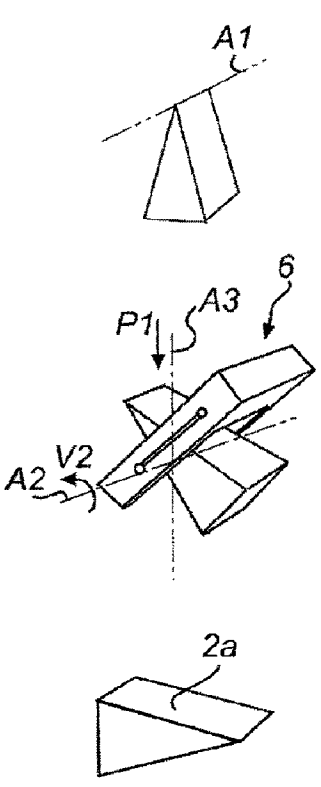

FIG. 5*f* illustrates the gripping unit 6 while moving from the gripping position to grip a container 2*b* from the second container side 19 to the placing position.

During this movement, the gripping unit 6 is moved along said movement axis A3 in the first movement direction P1 and pivoted about the pivot axis A2 in the second pivot direction V2 which is opposite to the first pivot direction V1.

Figure 5G:
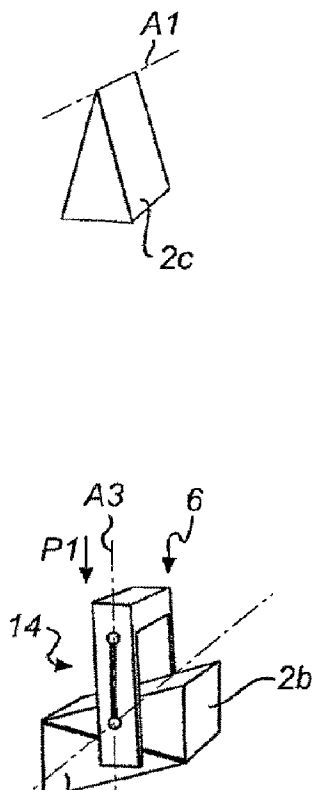

FIG. 5*g* shows the gripping unit 6 in the placing position, in which the second container 2*b* has been oriented with its first container side 18 facing downwards. The second container 2*b* can now be placed in the box (not shown), on the first container 2*a* but with the opposite orientation, by operating the gripping unit 6 to its non-gripping state.

After that, the gripping unit 6 (not shown) is again moved to the gripping position to grip a third container 2*c* from the first container side 18 by continued pivoting about the pivot axis A2 in the second pivot direction V2 and by moving along the movement axis A3 in the second movement direction P2 to repeat the above described process until the box (not shown) is filled with containers 2. As a result, the pattern of placing shown in FIG. 3 can be provided in the box.

In the embodiments above, the finger pairs 14 of the gripping unit 6 have been described to have an extent that is parallel to the arm 10 of the gripping unit 6. Provided that the pivot axis A2 extends through the centre of the containers 2 arranged in the packing position B along the longitudinal axis A1 when the gripping unit 6 is in the gripping position, pivoting of the containers 2 about said centre is achieved by pivoting of the gripping unit 6. However, it is possible to give the finger pairs 14 a different extent, which is shown in FIGS. 6*a*-6*i* which illustrate a third embodiment of the present invention.

In the third embodiment, the gripping unit 6 is arranged, in its gripping position, to alternately grip containers which have been moved to the packing position B from the first and the second container side. The gripping unit is moved between the gripping position and the placing position in a manner which essentially corresponds to that described above with reference to FIGS. 5*a*-5*g*.

What differs this embodiment from the one previously described is that in the third embodiment the back piece 13 of the gripping unit 6 is pivotally connected to the arm 10.

Figure 6A:
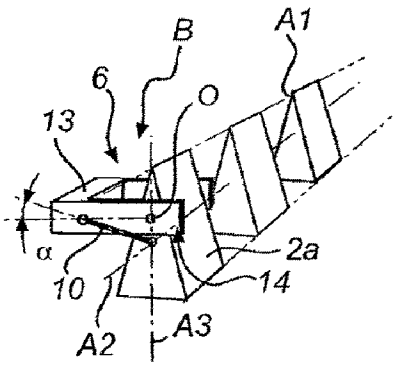
FIGS. 6*a*-6*i* illustrate schematically the method of placing in a distribution unit suspended containers by means of a gripping unit of an inventive device according a third embodiment.

When the gripping unit 6 is in the gripping position to grip a first container 2*a* from the first container side 18, which is shown in FIG. 6*a*, the back piece 13 has been pivoted relative to the arm 10 so that the finger pair 14 is horizontally arranged at an angle α to the arm 10. As a result, the finger pair 14 will, when the gripping unit 6 is operated to its gripping state, grip a first container 2*a* at a point O above the pivot axis A2.

Figure 6B:
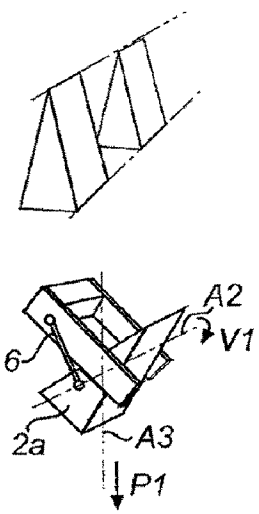
Figure 6C:
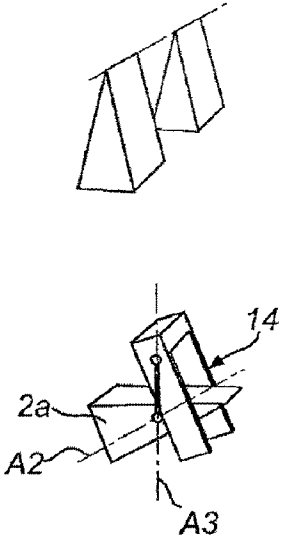

Then the gripping unit 6 is moved to the placing position, which is shown in FIGS. 6*b*-6*c*.

Figure 6D:
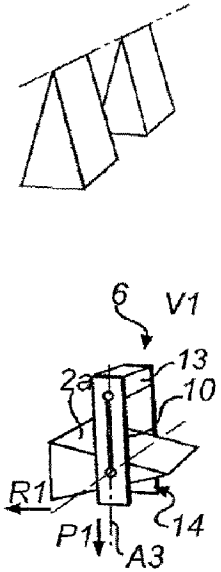

When the gripping unit 6 is in the placing position, the back piece 13 is pivoted so that the finger pair 14 is arranged parallel to the arm 10, which is shown in FIG. 6*d*. Alternatively, this pivoting could be performed during the movement to the placing position.

The pivoting of the back piece 13 relative to the arm 10 results in the finger pair 14 being oriented so as to point in the first movement direction P1. The pivoting also causes the first container 2*a* to be laterally displaced in a first direction R1.

Figure 6E:
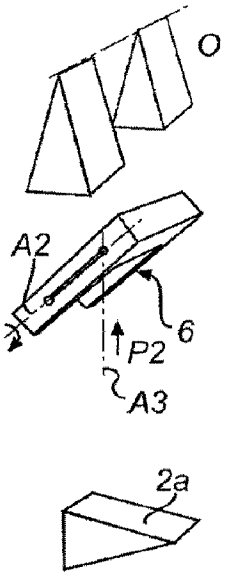
Figures 6F, 6G, 6H, 6I:
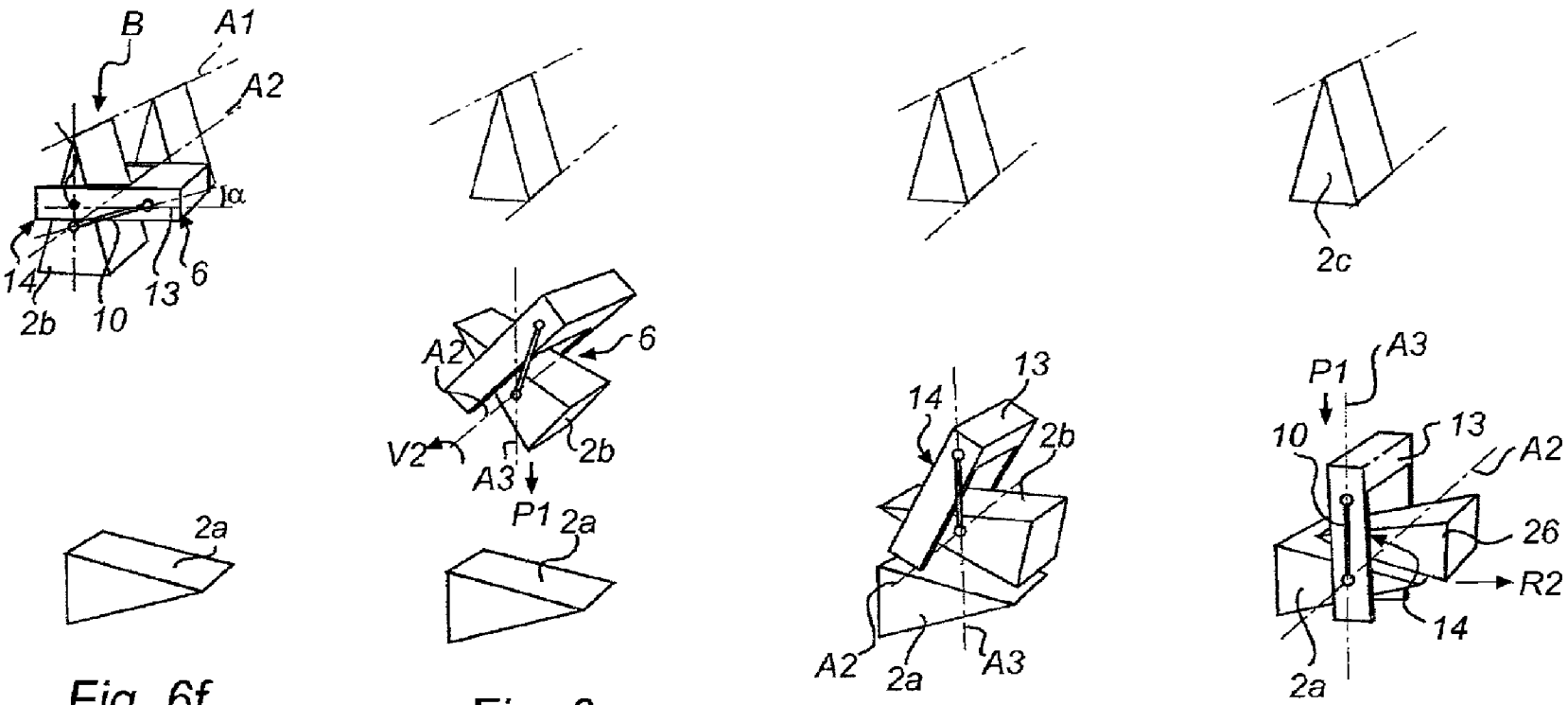

When the gripping unit 6 has been operated to its non-gripping state, it is moved to the gripping position for gripping a container 2*b* from the second container side 19, which is shown in FIGS. 6*e*-6*f*. In this gripping position, the back piece 13 has been pivoted relative to the arm 10 in such a manner that the finger pair 14 is horizontally arranged at an angle α to the arm 10. As a result, the finger pair 14 will act, when the gripping unit 6 is operated to its gripping state, to grip a second container 2*b* at a point O above the pivot axis A2. The orientation of the finger pair 14 by pivoting of the back piece 13 relative to the arm 10 could alternatively be performed during the movement to the gripping position in question.

After that, the gripping unit 6 is again moved to the placing position, in which the back piece 13 has again been pivoted relative to the arm 10, which is evident from FIGS. 6*g*-6*i*. The finger pair 14 is arranged parallel to the arm 10 so as to point in the first movement direction P1. The pivoting also causes the second container 2*b* to be laterally displaced, but in a second direction R2 which is opposite to the first direction R1.

Due to the gripping unit 6 being arranged to grip the containers 2*a*, 2*b* at a point O above the pivot axis A2, lateral separation of the containers 2*a*, 2*b* placed in the box 4 (not shown) is thus provided, which separation helps to further improve the use of the volume of the box 4.

This separation of the containers 2 placed in the box one on top of the other could be performed in other manners. Thus, it is for example possible to grip, by means of the gripping unit 6, the containers from both the first container side 18 and the second container side 19 at a point corresponding to the centre of the containers 2. The arm 10 is angled in such a manner relative to the finger pair 14 that the pivot axis A2 is arranged at a distance above said gripping point. By pivoting the gripping unit 6 above the pivot axis A2 during simultaneous movement along the movement axis A3, a lateral movement of the gripped container 2 is provided when the gripping unit is moved to the placing position.

According to the present invention, a device 1 is thus provided for placing filled and sealed containers 2 of a collapsible type in a distribution unit 3. The device 1 is arranged to fetch the containers 2 when they have been moved to a packing position B, in which they are suspended, one after the other along a longitudinal axis A1, that is in the state in which they can be provided in a filling machine. The gripping unit 6 comprises finger pairs which, in the gripping state of the gripping unit, make a squeezing motion. The gripped containers are of a collapsible type, that is flexible, and will thus yield in the gripped portion until the contents form an abutment or a counter-pressure structure which provides a well-defined grip.

The inventive device 1 can be designed as a module which is connected to the filling machine and which comprises an arrangement 5 for receiving the containers 2 in the suspended state, or be an integral part of the filling machine. By the device 1 being arranged to handle the containers in said suspended state, it is ensured that the device 1 can use the exact positioning of the containers 2 which is provided by the filling machine. The well-defined grip of the containers which is achieved ensures that the position of the containers is kept under control also after gripping.

The inventive device 1 further comprises a gripping unit 6 which can be arranged to grip containers 2 from a first container side 18, or alternatively, to alternately grip the containers 2 from opposite container sides 18, 19. The gripping unit 6 is further arranged to move, during pivoting and linear movement, the gripped containers 2 to a distribution unit 3, such as a box 4, to be placed one on top of the other.

If the containers 2 are exclusively gripped from a first container side 18, the containers 2 can be arranged in the distribution unit 3 with the same orientation. A thus filled distribution unit 3 can, for example, serve as a unit to expose the containers 2 at a point of sale, for instance by the distribution unit 3 being raised so that the containers 2 placed therein are put in an upright position.

The inventive device 1 also allows efficient use of the volume of the distribution unit 3 by placing the containers 2 with opposite orientation. This can be achieved by pivoting the distribution unit 3 each time containers 2 are placed in the same, or alternatively, by alternately gripping containers 2 from a first 18 and a second 19 container side.

The use of the volume of the distribution unit can be further improved by laterally displacing the groups of containers 2 that are placed on top of each other in the distribution unit 3. This lateral displacement can be performed, for example, by alternately gripping the containers from the first 18 and the second 19 container side, the grip occurring at a point above the pivot axis A2, or alternatively by the pivot axis A2 being arranged above the point at which gripping occurs.

The lateral displacement of the containers can also be performed by lateral displacement of the distribution unit in alternately opposite directions each time a group of containers is placed in the distribution unit.

A device 1 is thus provided, which with a relatively simple construction and in a rational manner is capable of placing containers 2 in a box 4 and which also allows efficient use of the volume of the box 4.

As described above, the gripping unit 6 of the device 1 can be arranged to grip containers 2 in groups of several containers 2. The gripping unit 6 can be arranged to grip a group of as many containers 2 as are accommodated on the bottom of the box 4, whereby a complete layer is formed each time the gripping unit 6 places a group of containers in the box 4.

It will be appreciated that the present invention is not limited to the embodiments described above.

For example, the finger pairs 14 of the gripping unit 6 can be movable relative to each other. This makes it possible to grip the suspended containers 2, which are arranged at a first distance from each other, and place the containers 2 in the box 4 at a second distance from each other by adjusting the distance between the finger pairs 14. The second distance can thus be smaller than the first distance in order to further improve the use of the volume of the box 4.

Several variations and modifications are thus conceivable, and therefore the scope of the present invention is exclusively defined by the appended claims.

The invention claimed is:

1. A device for placing filled and sealed containers of a collapsible type in a distribution unit, said containers being moved to a packing position, in which the containers are suspended and arranged along a horizontal longitudinal axis, comprising a gripping unit with a number of finger pairs corresponding to the number of containers in the packing position, each finger pair, in a non-gripping state of the gripping unit, having a finger gap which allows a container to pass, which gripping unit is operable to a gripping state, in which each finger pair is arranged to make a squeezing motion to grip a container on opposite sides with such a squeezing force that the contents of the container form an inner counter-pressure structure extending between said fingers to provide a well-defined grip.

2. A device as claimed in claim 1, in which the gripping unit is movable between a gripping position and a placing position, in which gripping position the gripping unit is arranged to grip the containers in the packing position by operating the gripping unit to its gripping state, and in which placing position the gripping unit is arranged to place the gripped containers in the distribution unit.

3. A device as claimed in claim 1, in which the gripping unit is movable along a movement axis, which is perpendicular to said longitudinal axis, the gripping unit being movable between the gripping position and a placing position by moving along said movement axis.

4. A device as claimed in claim 1, in which the gripping unit is pivotable about a pivot axis, which is parallel to said longitudinal axis.

5. A device as claimed in claim 4, in which the gripping unit is movable along a movement axis, which is perpendicular to said pivot axis and which coincides with a plane defined by said longitudinal axis and said pivot axis, the gripping unit being movable between the gripping position and a placing position by pivoting about the pivot axis and moving along the movement axis.

6. A device as claimed in claim 1, in which the gripping unit in its gripping position is arranged to grip containers in the packing position merely from one container side.

7. A device as claimed in claim 6, further comprising a handling element which is arranged to turn the distribution unit through 180° each time the gripping unit has placed containers in said distribution unit.

8. A device as claimed in claim 1, in which the gripping unit in its gripping position is arranged to grip containers in the packing position alternately from a first container side and a second container side.

9. A device as claimed in claim 1, in which the gripping unit is arranged to grip containers in groups of at least two containers.

10. A device as claimed in claim 1, in which the gripping unit comprises a back piece to support all finger pairs.

11. A device as claimed in claim 10, in which the back piece supports at least two finger pairs, the finger pairs being movable relative to each other between a pushed-together state and a separated state.

12. A device as claimed in claim 1, in which the gripping unit is pivotable about a pivot axis which is parallel to said longitudinal axis and movable along a movement axis, which is perpendicular to said pivot axis and coincides with a plane defined by said longitudinal axis and said pivot axis, further comprising a pivoting motor which is movable parallel to said movement axis, the gripping unit being pivotally supported by said pivoting motor for pivoting about said pivot axis.

13. A device as claimed in claim 12, in which said gripping unit is supported by the pivoting motor by means of an arm which is extended perpendicular to the pivot axis and which at a first end is connected to the pivoting motor and which at a second end is connected to a back piece.

14. A device as claimed in claim 13, in which the back piece is pivotally connected to the second end of said arm.

15. A device as claimed in claim 1, further comprising a handling element which is arranged to alternately laterally displace the distribution unit in mutually opposite directions before each placing of containers in the distribution unit.

* * * * *